United States Patent [19]

Ito

[11] Patent Number: 4,808,954

[45] Date of Patent: Feb. 28, 1989

[54] SUPERCONDUCTING COIL APPARATUS

[75] Inventor: Daisuke Ito, Yokohama, Japan

[73] Assignee: Kabushiki Kaisha Toshiba, Kawasaki, Japan

[21] Appl. No.: 197,406

[22] Filed: May 23, 1988

[30] Foreign Application Priority Data

May 26, 1987 [JP] Japan ..... 62-128823

[51] Int. Cl.[4] ..... H01F 7/22

[52] U.S. Cl. ..... 335/216; 335/300; 174/125.1

[58] Field of Search ..... 335/216, 299; 174/125.1; 336/DIG. 1

[56] References Cited

U.S. PATENT DOCUMENTS

| | | | |
|---|---|---|---|
| 3,514,730 | 5/1970 | Kassner | 335/216 |
| 3,559,126 | 1/1971 | Drautman | 174/125.1 |
| 3,801,942 | 4/1974 | Elsel | 335/216 |
| 4,467,303 | 8/1984 | Laskaris | 174/125.1 X |

OTHER PUBLICATIONS

IEEE Trans. MAG-15,843, "Conceptual Designs of 50kA 20MJ Superconducting Ohmic Heating Coils", Singh et al., Jan. (1979).

IEEE Trans. PAS-100, 7, 3398, "Application of Superconducting Technology to Power Transformers." H. Riemersma et al., Jul. 1981.

*Primary Examiner*—George Harris

*Attorney, Agent, or Firm*—Oblon, Fisher, Spivak, McClelland & Maier

[57] ABSTRACT

A superconducting coil apparatus comprises a first coil unit and second coil unit disposed concentrically outside the first coil unit. The second coil unit includes a cylindrical former having a spiral groove formed on an outer surface thereof, and a coil element constituted by a superconducting wire fitted in the spiral groove to form a spiral shape. The former is composed of a plurality of former segments which are assembled into a cylindrical foam. Each segment has a plurality of recess portions formed on the outer surfaces thereof and defining the spiral groove when the segments are assembled into the former. Each segment has a fluid passage formed on the outer surfaces thereof to permit the cooling medium to flow therethrough to come in contact with the superconducting wire. Thus, the coil apparatus is easy to assemble and relatively compact. Further, the spiral groove has V-shaped cross section, so that the superconducting wire will not be shifted in the axial direction of the coil element.

16 Claims, 6 Drawing Sheets

SUPERCONDUCTING COIL APPARATUS

BACKGROUND OF THE INVENTION

1. Field of the Invention

The present invention relates to a superconducting coil apparatus, and, in particular, to superconducting coil apparatus which has a plurality of formers concentrically disposed, each former having a superconducting wire wound around its outer surface in spiral.

2. Description of the Related Art

Super conductive coil apparatuses generally have a plurality of coil elements concentrically disposed, each element having a spiral wire, in order to be compact without reducing the electromagnetic force generated by the coil apparatuses. Unlike normal conductive coil apparatuses, however, superconducting coil apparatuses should have superconducting wires cooled by a cooling medium to be in a superconducting state. In this respect, conventional superconducting coil apparatuses are constituted as follows.

As shown in FIG. 1, a plurality of coil units 51 and 55 each having a coil element are concentrically arranged. The first coil unit 51, disposed at the center, comprises a cylindrical core member 52 and a plurality of plate-shaped spacers 53 arranged on the outer surface thereof to constitute a cylindrical member. A superconducting wire is wound in spiral around the outer surface of the cylindrical member constituted by the spacers, thus constituting a first coil element 54. The second coil unit 55, disposed outside the first coil unit 51, is similarly constituted. To be specific, the second coil unit 55 has a plurality of plate spacers 56 disposed around the outer surface of first coil unit 51 and constituting a cylindrical member. A superconducting wire is wound in spiral around the outer surface of this cylindrical member, thus constituting a second coil element 57. Though not illustrated, a plurality of other coil units are disposed outside the second coil unit 55.

In assembling a superconducting coil apparatus of this type, however, it is necessary to wind a superconducting wire around the outer surfaces of a plurality of spacers of each coil unit after sequentially arranging these spacers. This assembling is therefore trouble some. Further, the superconducting coil apparatus generates a significantly high magnetic field as compared with normal superconducting coil apparatuses, thus causing significant large force to act on the superconducting wire. This necessitates that the superconducting coil apparatus have very high mechanical strength. In the superconducting coil apparatus shown in FIG. 1, however, since a cylindrical member is constituted by a number of spacers arranged side by side in circle, this cylindrical member may be deformed by coil-generated electromagnetic force. In other words, the conventional superconducting coil apparatus does not have a sufficiently high mechanical strength. In addition, superconducting coil apparatuses are soaked in a cooling medium so that the superconducting wires are cooled by the cooling medium. In the coil apparatus shown in FIG. 1, however, the superconducting wires may not come in sufficient contact with the cooling medium.

The superconducting coil apparatus of FIG. 1 has various shortcomings as mentioned above. As a solution to the problems, there has been proposed a superconducting coil apparatus as shown in FIG. 2 (though this coil apparatus is not completed yet, nor has it been worked yet).

As shown in FIG. 2, first and second coil units 61 and 62 respectively have first and second cylindrical insulative formers 63 and 64 molded of resin. Each former has fluid passages 65 for passing a cooling medium and a plurality of recess portions 66 which, in association with one another, constitute a spiral groove. Second former 62 is disposed concentric to and outside first former 62, and outside the second former 62 are similarly disposed other formers (not shown) which are constituted in the same manner as the first and second formers. In assembling the superconducting coil apparatus, therefore, a superconducting wire is fitted in recess portions 66 to thereby be wound in spiral around formers 61 and 62. This facilitates the assembling work. In addition, the cooling medium flows through fluid passages 65 and comes in touch with the superconducting wire to thereby effectively cool the wire. As each former is molded into a cylindrical shape, it has a sufficiently high mechanical strength.

In assembling the superconducting coil apparatus, however, first former 63 should be inserted in second former 64 after the superconducting wire is wound around the former former 63, and this inserting work is very troublesome.

To facilitate the above inserting work, there should be a predetermined gap (play) provided between the outer surface of first former 63 and the inner surface of second former 64. When a number of formers are concentrically arranged, therefore, there need a number of gaps (plays) accordingly. This inevitably enlarges the coil apparatus.

Further, the superconducting wires are not wound around the axial-directional end portions of the first and second formers (the upper end portions of the winding frames in FIG. 2). When wound around the first and second formers, the superconducting wires are applied with predetermined tension (the reason for nonwinding at the end portions and this tension will be explained in the description of the preferred embodiments). In addition, the superconducting wire wound around first former 63 is also continuously wound around second former 64. For this purpose, second former 64 is provided with a groove 67 extending to an associated recess portion 66 from the axial-directional end portion (upper end portion). The superconducting wire extending from first former 63 and given with predetermined tension is guided downward from the upper end of this groove 67 to be fitted in the recess portion 66. When guided in this manner, the superconducting wire scrapes or touches the edge of groove 67 and may be damaged or cut in the worst case. Further, it is tiresome to guide the tensed superconducting wire along groove 67.

Furthermore, the electromagnetic force acting on the superconducting wire is separated into the compression force of the coil element in its axial direction and the warp force of the same coil element in its radial direction. Since the shape of the recess portions is not matched with that of the superconducting wire, the superconducting wire, when applied with the compression force, may be shifted in the axial direction. This causes friction between the superconducting wire and the outer surfaces of the first and second formers, thus generating heat. This heat causes transition of the superconducting wire from the superconducting state to the normal conductive state. That is, quenching occurs. It is therefore desirable that the shifting of the superconducting wire by the compression force be prevented.

SUMMARY OF THE INVENTION

It is a primary object of this invention to provide a superconducting coil apparatus, which permits the superconducting wires to be sufficiently cooled by a cooling medium, has a high mechanical strength and is easy to assemble and compact.

It is another object of this invention to provide a superconducting coil apparatus which can prevent the superconducting wires from shifting by electromagnetic force generated by its coil elements.

According to one aspect of this invention, there is provided a superconducting coil apparatus, having superconducting wires and soaked in a cooling medium so that the superconducting wires in touch with the cooling medium is cooled, which apparatus comprises:

a first coil unit including, a cylindrical first former having a first groove formed in spiral on an outer surface thereof, and a first coil element constituted by part of a superconducting wire fitted in the first groove to form a spiral shape, the first former having a first fluid passage formed on the outer surface thereof to permit the cooling medium to flow therethrough to come in contact with the superconducting wire; and a second coil unit including, a cylindrical second former having a second groove formed in spiral on an outer surface thereof and disposed concentrically outside the first former, and a second coil element constituted by another part of a superconducting wire fitted in the second groove to form a spiral shape, the second former composed of a plurality of former segments which are assembled into a cylindrical form, each segment having a plurality of recess portions formed on the outer surfaces thereof and defining the second groove when the segments are assembled into the second former, and a second fluid passage formed on the outer surfaces of the segments to permit the cooling medium to flow therethrough to come in contact with the superconducting wire.

According to this invention, the second former is composed of a plurality of former segments having recess portions to receive the superconducting wire and a fluid passage for permitting the cooling medium to flow therethrough. In assembling this superconducting coil apparatus, therefore, the second former is formed by aligning these former segments outside the first former after the superconducting wire is wound around the first former. Unlike the coil apparatus shown in FIG. 2, therefore, the present coil apparatus does not need the inserting work, which facilitates the assembling of the second former. Therefore, a predetermined gap or play need not be provided between first former and the second former, so that the present coil apparatus can be relatively compact.

Further, when the superconducting wire extending from the first former is wound around the second winding frame, it can be passed between any two former segments (see FIGS. 6A and 6B). Unlike the apparatus shown in FIG. 2, therefore, the superconducting wire will not be damaged or cut.

In addition, according to this invention, the spiral groove formed in the outer surfaces of the first and second former have a V-shaped cross section, so that, when the circular superconducting wire is fitted in the V-shaped grooves, the superconducting wire can always supported at two points of the inner wall of each groove. Even axial-directional compression force of each coil element is applied to the superconducting wire, therefore, the superconducting wire will not be shifted in the axial direction of the coil element. Also, irrespective of the size of the diameter of the superconducting wire it is supported at two points of the inner wall of each V-shaped groove and will not be shifted.

DETAILED DESCRIPTION OF THE PREFERRED EMBODIMENTS

Figure 3:
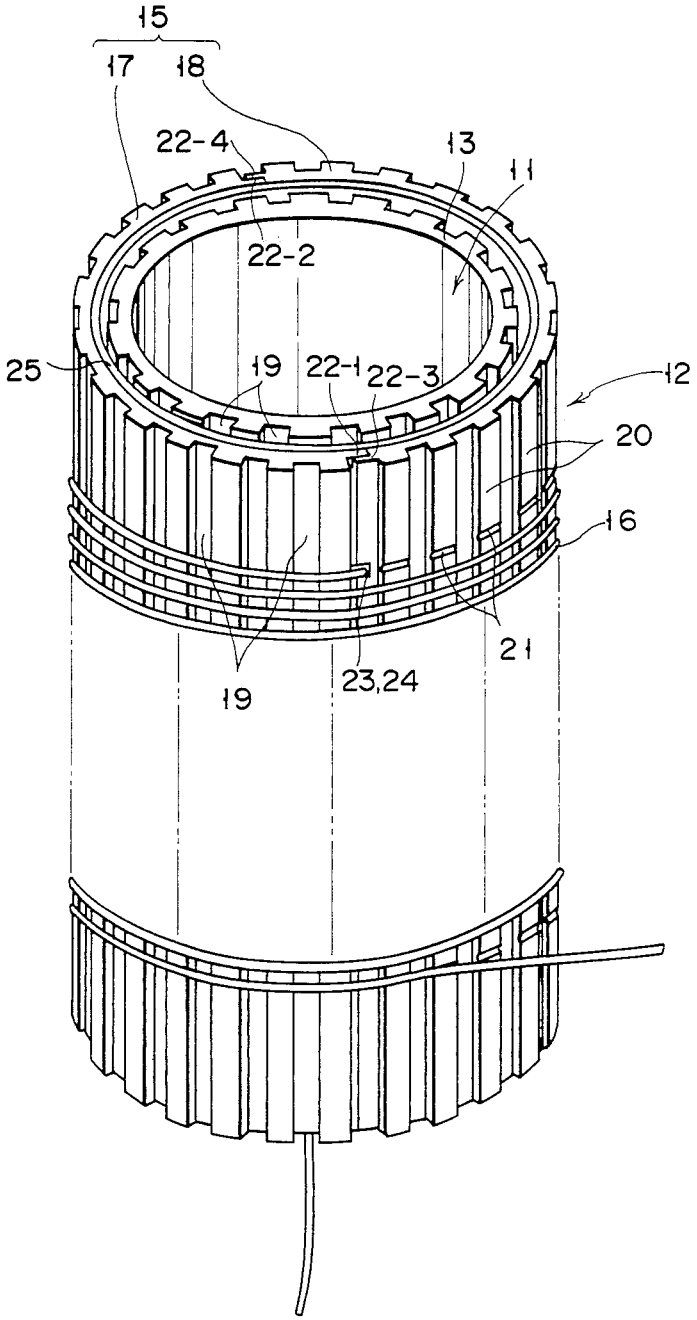
FIG. 3 is a perspective view of a superconducting coil apparatus according to this invention.

FIG. 3 illustrates a superconducting coil apparatus according to an embodiment of this invention. This coil apparatus comprises a plurality of (e.g., 10) coil units which are concentrically arranged. FIG. 3 simply illustrates a first coil unit 11 and a second coil unit 12 concentrically arranged outside the first coil unit. These coil units are soaked in a cooling medium (liquid helium), so that the superconducting wire in contact with the cooling medium is cooled and is therefore maintained in a superconducting state.

First coil unit 11 includes a cylindrical first former 13 and a first coil element 14 (see FIGS. 6A and 6B) constituted by part of the superconducting wire wound in spiral around the outer surface of the first former 13. Second coil unit 12 also includes a cylindrical second former 15 concentrically disposed outside first former 13 and a second coil element 16 constituted by part of the superconducting wire wound in spiral around the outer surface of the second former 15. First and second formers 13 and 15 have substantially the same structure except that the structure of second former 15 is divided in the circumferential direction. In this respect, the following description is mainly given with reference to second former 15, simplifying the description of first former 13.

Figure 4:
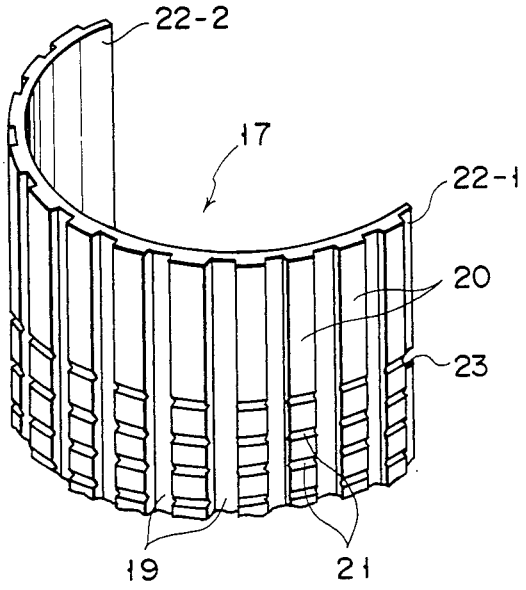
FIG. 4 is a perspective view of former segments constituting the superconducting coil apparatus shown in FIG. 3.

Second former 15 is formed of an insulative resin, such as glass fiber reinforced plastic or bakelite. As shown in FIGS. 3 and 4, second former 15 comprises two (first and second) former segments 17 and 18 separated in the circumferential direction of this frame 15. That is, former segments 17 and 18 are aligned (or assembled) in the circumferential direction of the former or in an annular shape, thus constituting cylindrical second former 15.

Figure 5:
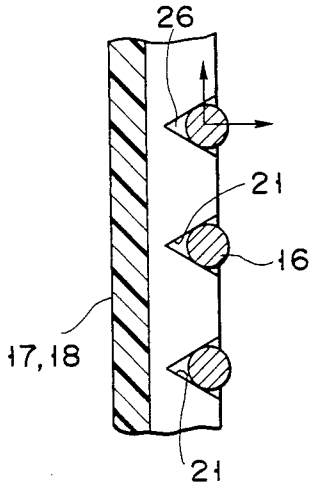
FIG. 5 is a axial-directional cross section of first and second formers constituting the superconducting coil apparatus shown in FIG. 3.

In the outer surface of each of former segments 17 and 18, are formed a plurality of fluid passages (fluid passage grooves) 19 which extend in the axial direction of the second former and pass the cooling medium. Between two adjacent fluid passages 19 is a ridge 20 defined, which extends in the axial direction of the second former. A plurality of recess portions 21 extending in substantially the circumferential direction of ridge 20 are formed in the outer surface thereof, and define, in mutual association, a spiral groove when segments 17 and 18 are aligned in the circumferential direction. The spiral direction of this groove is the same as the threaded direction of a right-handed screw (whereas the spiral direction of the spiral groove formed in first former 13 is the same as the threaded direction of a left-handed screw). As shown in FIG. 5, these recess portions 21 each have a V-shaped cross section. Second coil element 16 is constituted by part of the superconducting wire fitted in recess portions 21. The superconducting wire is formed in spiral with equal pitches between turns. As will be described later, when the axial-directional electromagnetic force generated by the coil element is applied to the superconducting wire fitted in these V-shaped recess portions, the superconducting wire is not shifted in the axial direction.

Figure 6A:
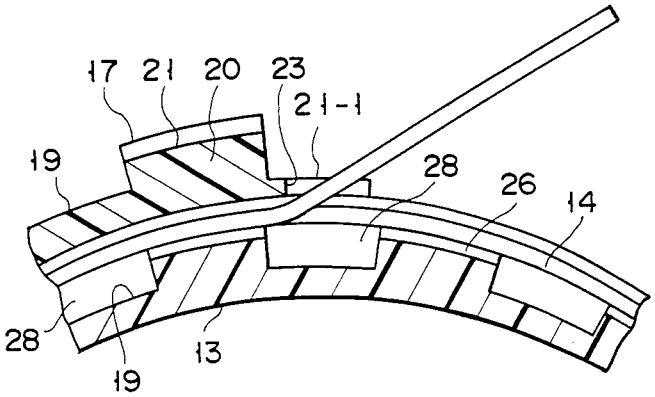
FIGS. 6A and 6B are circumferential cross sections of the superconducting coil apparatus shown in FIG. 3 and illustrating processes for assembling the apparatus.
Figure 6B:
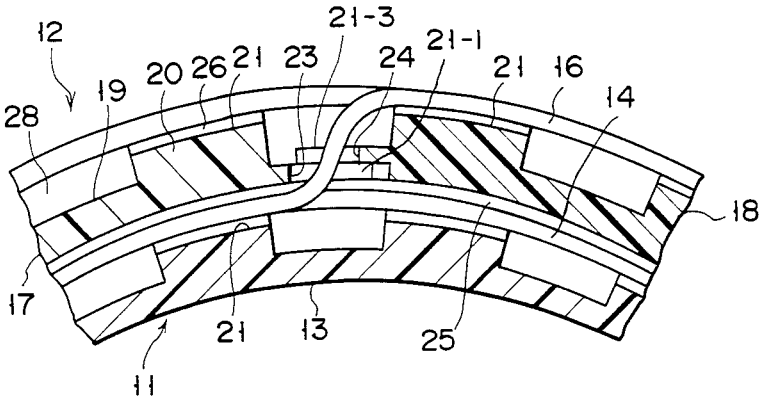
Figure 7:
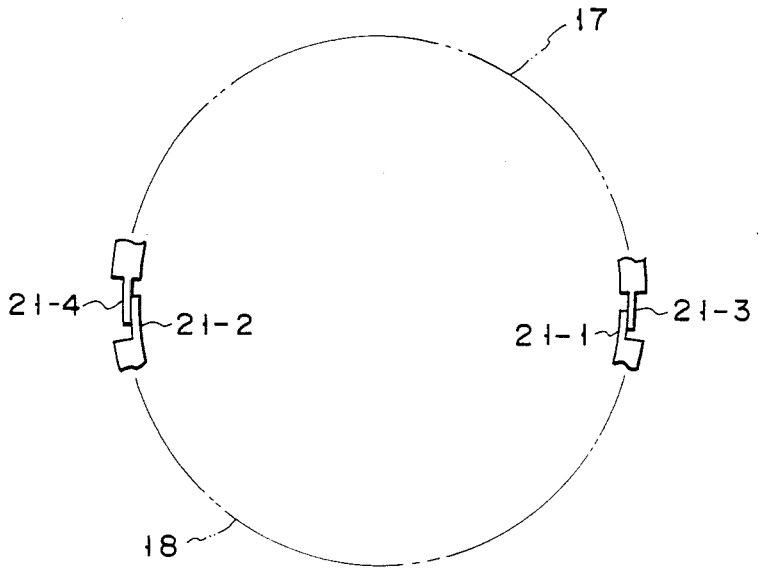
FIG. 7 is an schematic plan view of the second former constituting the superconducting coil apparatus shown in FIG. 3.

As shown in FIGS. 6A and 6B, fluid passage 19 is deeper than recess portions 21, so that a predetermined gap 28 is defined by the inner wall of fluid passage 19 and a portion of the superconducting wire. As will be described later, the cooling medium can flow through this gap 28 by natural convection.

Outside second coil unit 12, are disposed a plurality of coil units (not shown) whose formers are constituted in the same manner as the second former.

As shown in FIGS. 4, 6A, 6B and 7, segments 17 and 18 of second former 15 have, at their circumferential end portions, thin portions 22-1 to 22-4. Thin portions 22-1 and 22-3 overlap each other, and the other thin portions 22-2 and 22-4 also overlap each other. The thin portions 22-1 and 22-3 respectively have cutaways 23 and 24 formed therein, through which the superconducting wire wound around first former 13 is guided to the outer surface of second former 15.

Further, a high molecular film 25 with high insulating power, such as Mylar or Kapton, is provided between first coil unit 11 and second coil unit 12 to insulate first coil element 14 and second coil element 16.

The following describes assembling of the superconducting coil apparatus according to this embodiment.

The superconducting wire while being tensed, is fitted in the spiral groove (i.e., a plurality of recess portions 21) formed in first former 13. When the superconducting wire is fitted until the end of this spiral groove, it is wound in spiral to constitute first coil element 14. Thereafter, first coil unit 11 is covered with high molecular film 25. Then, as shown in FIG. 6A, one former segment 17 is disposed at the side of first coil unit 11. The superconducting wire extending from first coil unit 11 and given with predetermined tension is passed through cutaway 23 of thin portion 22-1 of former segment 17. Thereafter, as shown in FIG. 6B, the other former segment 18 is disposed at the side of first coil unit 11 and thin portions 22-1 and 22-2 of segment 17 are laid over thin portions 22-3 and 22-4 of segment 18. Consequently, segments 17 and 18 are aligned with each other, thus constituting second former 15. At this time, the superconducting wire extending from first coil unit 11 and given with predetermined tension, is passed through cutaway 24 of thin portion 22-3 of segment 18 and is guided to the outer surface of segment 18. Thereafter, the superconducting wire given with predetermined tension is fitted in the spiral groove (i.e., a plurality of recess portions 21) formed in second former 15, thus constituting second coil element 16. Thereafter, other formers (not shown) each comprising two former segments are concentrically disposed outside second former 15. These other former are also wound around with the superconducting wire, thus completing the superconducting coil apparatus.

According to this invention, as mentioned above, since the second former comprises two former segments, the following three effects are attained.

The first effect is easy assembling of the superconducting coil apparatus.

Figure 1:
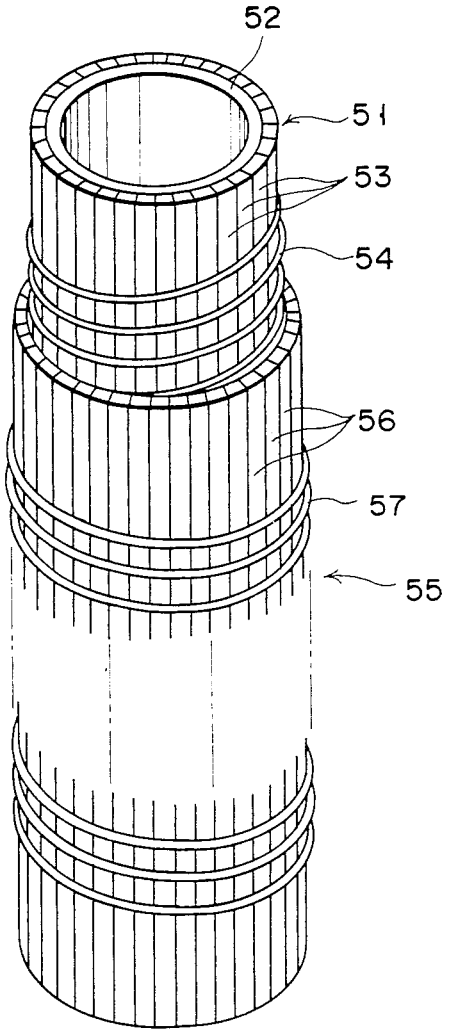
FIG. 1 (PRIOR ART)
FIG. 1 is a perspective view of a superconducting coil apparatus according to the prior art.
Figure 2:
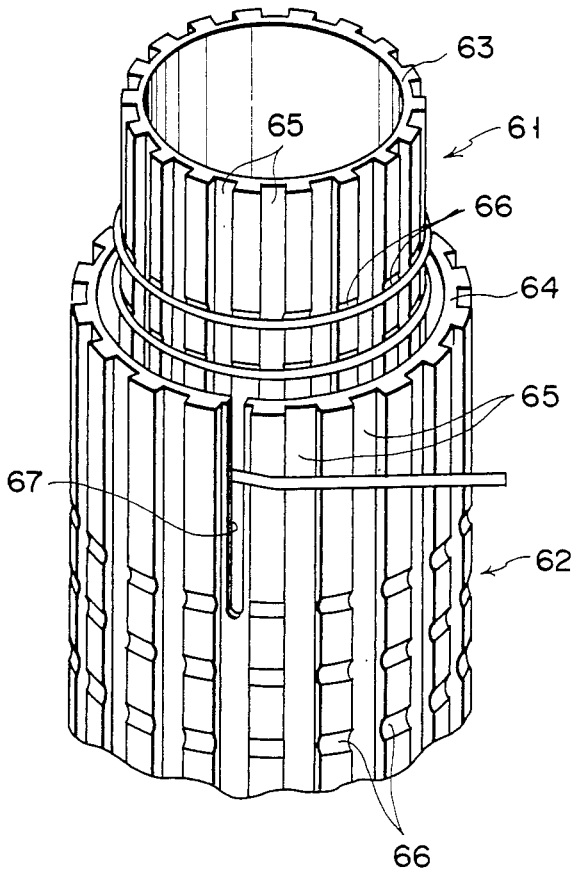
FIG. 2 is a perspective view of a superconducting coil apparatus presently proposed but not yet worked.

A plurality of cylindrical formers are concentrically arranged in the superconducting coil apparatus shown in FIG. 2. Therefore, in assembling this coil apparatus, first former 63 needs to be inserted in second formers 64 in its axial direction. This inserting work is done after the superconducting wire is wound around the outer surface of first former 63. This fitting work is considerably troublesome.

In contrast, according to this invention, after the superconducting wire is wound around cylindrical first former 13, two former segments 17 and 18 are aligned in the circumferential direction outside of the first former, thus constituting second former 15. Unlike the coil apparatus of FIG. 2, therefore, the present coil apparatus does not need the aforementioned inserting work, and can facilitate the assembling of a plurality of formers. In other words, the superconducting coil apparatus can easily be assembled.

The second effect is that a superconducting coil apparatus can be made relatively compact.

With the coil apparatus shown in FIG. 2, in order to execute the inserting work smoothly, it is necessary to provide a predetermined gap (play) between the outer surface of first former 63 and the inner wall of second former 64. With a number of formers concentrically arranged, therefore, there should be a number of gaps (plays) accordingly. As a result, the coil apparatus is enlarged, which is not suitable for superconducting coil apparatuses that are characterized in their compactness.

In contrast, according to this invention, since the fitting work is unnecessary, as mentioned earlier, such a predetermined gap or play need not be provided between first former and the second former, even when a number of formers are concentrically arranged. This feature can make a superconducting coil apparatus relatively compact.

The third effect is that when wound around the former, the superconducting wire will not be damaged. Before going into a description of the third effect, two points which are premises of this effect will be explained below.

In winding the superconducting wire around each former, predetermined tension should be applied to the wire for the following reason. A coil element in operation generates an electromagnetic force, which is separated into axial-directional compression force of the coil element ad radial-directional hoop force of the coil element. As the compression force and hoop force act on the superconducting wire, the wire may shift in the axial or radial direction. This shifting causes a friction between the superconducting wire and the formers, thus generating heat. This heat causes a transition of the wire from a superconducting state to a normal conductive state, i.e., quenching occurs. To prevent the wire shifting as much as possible, therefore, the superconducting wire is given tension while it is being wound around the formers.

Further, the superconducting wire is not wound around the axial-directional end portions of the first and second formers (upper and lower end portions in FIG. 3) and is wound around only the middle portions of these formers for the following reason. A superconducting coil apparatus is applied with a significantly high voltage, so that it is necessary to prevent the first and second coil elements from causing a creeping discharge via the axial-directional end portions (upper and lower end portions in FIG. 3) of the first and second formers. This necessitates that a predetermined creeping distance of insulation be provided between the superconducting wire at the end of the first coil element and the superconducting wire at the end of the second coil element. In this respect, the superconducting wire is not wound around the axial-directional end portions of the first and second formers.

The third effect will now be explained.

After the superconducting wire is wound around the first former, it is also wound around the second former. As mentioned above, the wire is not wound around the end portions of the first and second formers. According to the superconducting coil apparatus of FIG. 2, groove 67 extending from the axial-directional edge (upper edge) of second former 64 to recess portion 66 is formed in order to guide the superconducting wire. The superconducting wire extending from the first former and given predetermined tension is guided downward from the upper end of groove 67 to recess portion 66. When the superconducting wire is guided, it scrapes or hits against the edge of groove 67 so that it may be damaged or cut at the worst.

In contrast, according to this invention, after one former segment 17 is disposed outside of first former 13, the superconducting wire given with tension is passed through cutaway 23 of that segment 17 as shown in FIG. 6A. Then, as shown in FIG. 6B, while the superconducting wire is being passed through cutaway 24 of the other former segment 18, this segment 18 is aligned with winding frame segment 17. Accordingly, the superconducting wire is guided through cutaways 23 and 24 to the outer surface of former segment 18. Unlike the coil apparatus shown in FIG. 2, therefore, the present coil apparatus does not need to guide the superconducting wire into groove 67 extending in the axial direction of the former. With this design, the superconducting wire will not be scraped against the edge of groove 67 and will not be damaged.

Further, since recess portions forming the spiral groove have a V-shaped cross section as shown in FIG. 5, the following effect can be attained.

As mentioned earlier, when the superconducting coil apparatus is in operation, the axial-directional compression force of a coil element and the radial-directional hoop force of that coil element act on the superconducting wire of the coil element. Therefore, it is possible that the superconducting wire is shifted in the axial or radial direction. According to this invention, however, the superconducting wire with a circular cross section is fitted in recess portions 21 with a V-shaped cross section, so that the superconducting wire is always supported at two points of the inner wall of each recess portion 21. Irrespective of size of the diameter of the superconducting wire, the wire is supported by recess portions 21. That is, it is unnecessary to vary the size of the recess portions in accordance with the size of the diameter of the superconductive wire. Irrespective of the size of the diameter of the superconducting wire, therefore, the superconducting wire can very easily be prevented from being shifted in the axial direction of the coil.

At the time of winding the superconducting wire, the wire is also assuredly supported at recess portions 21 and does not come off the recess portions. This facilitates the wire winding work.

Further, as shown in FIGS. 6A and 6B, predetermined gap 28 is defined by the inner wall of fluid passage 19 and a portion of the superconducting wire, so that the cooling medium can flow through the gap 28 by natural convection that is caused as follows. Due to alternate current loss of the coil elements, slight heat is generated, which boils the cooling medium to thereby form bubbles. The bubbles move upward in gap 28, thus generating a flow of the cooling medium within the gap or the natural convection. As a result, the superconducting wire is effectively cooled by the cooling medium. In addition, as gap 26 is formed between the bottom portion of recess portion 21 and the superconducting wire, the cooling medium also flows through, thus cooling the superconducting wire more effectively.

According to this invention, since insulative high molecular film 25 is provided between the first and second formers, reduction in insulation power at those portions of two former segments 17 and 18 where thin portions 22-1 to 22-4 overlap one another can be prevented.

In the above embodiment, the second former is constituted by two former segments; however, it may be constituted by three or more former segments.

What is claimed is:

1. A superconducting coil apparatus, having superconducting wires and soaked in a cooling medium so that said superconducting wires in touch with the cooling medium is cooled, said apparatus comprising:

a first coil unit including a cylindrical first former having a first groove formed in spiral on an outer surface thereof, and a first coil element constituted by part of a superconducting wire fitted in said first groove to form a spiral shape, said first former having a first fluid passage formed on the outer surface thereof to permit the cooling medium to flow therethrough to come in contact with said superconducting wire; and a second coil unit including a cylindrical second former having a second groove formed in spiral on an outer surface thereof and disposed concentrically outside said first former, and a second coil element constituted by another part of a superconducting wire fitted in said second groove to form a spiral shape, said second former composed of a plurality of former segments which are assembled into a cylindrical foam, each segment having a plurality of recess portions formed on the outer surfaces thereof and defining said second groove when said segments are assembled into said second former, and a second fluid passage formed on the outer surfaces of said segments to permit the cooling medium to flow therethrough to come in contact with said superconducting wire.

2. A superconducting coil apparatus according to claim 1, wherein said second former has a cutaway formed between two adjacent former segments, through which said superconducting wire extending from said first former is passed and is guided to the outer surface of said second former.

3. A superconducting coil apparatus according to claim 2, wherein each of said former segments has an end portion in a circumferential direction thereof, and an overlapping portion where said end portion of one of said former segments overlaps said end portion of said other former segments, and said cutaway is formed in said overlapping portion.

4. A superconducting coil apparatus according to claim 1, wherein said first and second formers are formed of an insulative resin.

5. A superconducting coil apparatus according to claim 1, wherein said second former has two former segments.

6. A superconducting coil apparatus according to claim 1, wherein each of said former segments has a plurality of ridges formed on the outer surface thereof and extending in an axial direction of said second former, and a fluid passage groove, provided between adjacent ones of said ridges, for defining said second fluid passage.

7. A superconducting coil apparatus according to claim 6, wherein said recess portions are formed on outer surfaces of said ridges.

8. A superconducting coil apparatus according to claim 1, wherein said recess portions have a V-shaped cross section.

9. A superconducting coil apparatus according to claim 8, wherein said superconducting wire has a circular cross section and each of said recess portions has a bottom portion, a gap for permitting of flow of said cooling medium being defined between said bottom portion and that portion of said superconducting wire which faces said bottom portion when said superconducting wire is fitted in said recess portions.

10. A superconducting coil apparatus according to claim 6, wherein said recess portions are shallower than said fluid passage grooves.

11. A superconducting coil apparatus according to claim 1, further comprising:

an insulative film disposed between said first and second coil units.

12. A superconducting coil apparatus, having superconducting wires and soaked in a cooling medium so that said superconducting wires in touch with the cooling medium is cooled, said apparatus comprising:

first and second coil units each including, a cylindrical former having a groove with a V-shaped cross section formed in spiral on an outer surface thereof, and a fluid passage formed on the outer surface thereof and permitting the cooling medium to flow therethrough, said former of said first coil unit being disposed concentrical to that of said second coil unit, and a coil element constituted by part of said superconducting wire fitted in said groove to form a spiral shape and brought into contact with the cooling medium in said fluid passage.

13. A superconducting coil apparatus according to claim 12, wherein each of said formers has a plurality of ridges formed on the outer surface thereof and extending in an axial direction thereof and a fluid passage groove, provided between adjacent ones of said ridges, for defining said fluid passage.

14. A superconducting coil apparatus according to claim 13, wherein each of said formers has a plurality of recess portions formed on outer surfaces of said ridges and defining, in association with one another, said spiral groove.

15. A superconducting coil apparatus according to claim 14, wherein said superconducting wire has a circular cross section and each of said recess portions has a bottom portion, a gap for permitting of flow of said cooling medium being defined between said bottom portion and that portion of said superconducting wire which faces said bottom portion when said superconductive wire is fitted in said recess portions.

16. A superconducting coil apparatus according to claim 15, wherein said recess portions are shallower than said fluid passage grooves.

* * * * *